United States Patent [19]

Alexandrov et al.

[11] 4,320,321

[45] Mar. 16, 1982

[54] HOLLOW-CATHODE GAS-DISCHARGE TUBE

[76] Inventors: Vitaly V. Alexandrov, korpus 610, kv. 22, Moscow, 103489; Anatoly I. Bezlepkin, korpus 200"V", kv. 61, Moscow, 103460; Boris A. Konstantinov, korpus 508, kv. 29, Moscow, 103536; Olga V. Melnikova, korpus 1, kv. 8, Moscow, B. Demidovsky pereulok, 17; Anatoly S. Khomyak, korpus 320, kv. 68, Moscow, 103482; Lev I. Schukin, korpus 921, kv. 203, Moscow, 103482; Marat S. Chukin, korpus 418, kv. 113, Moscow, 103498, all of U.S.S.R.

[21] Appl. No.: 133,930

[22] Filed: Mar. 25, 1980

[51] Int. Cl.[3] ..... H01J 17/04; H01J 61/04

[52] U.S. Cl. ..... 313/209

[58] Field of Search ..... 313/205, 209, 313, 210

[56] References Cited

U.S. PATENT DOCUMENTS

| | | | |
|---|---|---|---|
| 3,242,371 | 3/1966 | Sugawara et al. . | |
| 3,264,511 | 8/1966 | Yamasaki . | |
| 3,476,970 | 11/1969 | Gillies et al. | 313/209 |
| 3,596,127 | 7/1971 | Yasuda et al. | 313/209 |
| 3,725,716 | 4/1973 | Yamasaki | 313/209 |
| 4,071,802 | 1/1978 | Yamasaki | 313/209 |

FOREIGN PATENT DOCUMENTS

| | | |
|---|---|---|
| 276398 | 11/1964 | Australia . |
| 276397 | 10/1965 | Australia . |
| 417029 | 1/1969 | Australia . |
| 423699 | 3/1969 | Australia . |
| 395927 | 8/1973 | U.S.S.R. . |

OTHER PUBLICATIONS

*Hollow Cathode Lamp data,* Varian Techtron Pty., Ltd. (73).

*Primary Examiner*—Bruce C. Anderson

*Attorney, Agent, or Firm*—Fleit & Jacobson

[57] ABSTRACT

A hollow-cathode gas-discharge tube comprises an anode and a cathode contained within a suitable envelope and isolated from one another, the cathode being provided with a cylindrical cavity having a diameter d, which is open on the side of the anode. The anode represents a hollow body of revolution arranged coaxially with the cathode cavity and composed of a hollow cylindrical portion mating a hollow variable-section portion. One portion of the anode represents a hollow cylindrical structure having a cavity diameter D, its bottom being provided with a central opening and disposed level with or below the end surface of the cathode. The other portion of the anode contains a cavity whose diameter evenly increases in the direction of emission from the cavity diameter D of the cylindrical portion of the anode, a height l of the cylindrical portion of the anode, its cavity diameter D, and the diameter d of the cylindrical cavity of the cathode being related to one another as follows:

$$3d \leqq l \leqq 6d$$

$$2 \leqq D/d \leqq 4.$$

1 Claim, 1 Drawing Figure

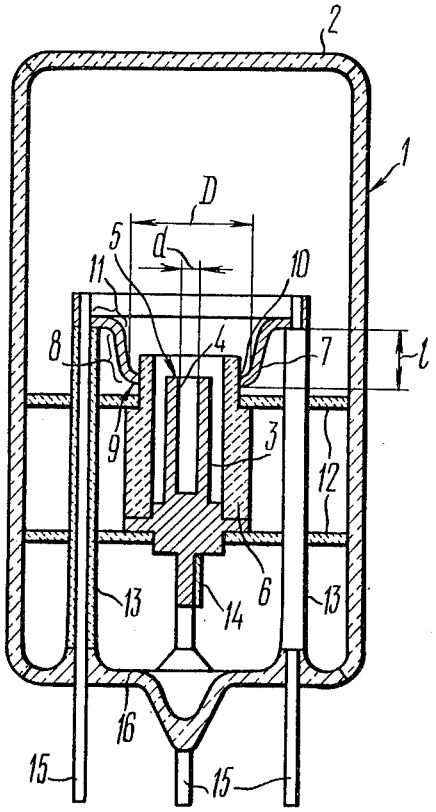
2
1
D
d
5
11
10
8
4
7
l
9
3
12
6
13
14
13
16
15
15

HOLLOW-CATHODE GAS-DISCHARGE TUBE

FIELD OF THE INVENTION

The present invention relates to cathode-emission gas-discharge glow devices designed for measuring intensity and spectral composition of visible and ultraviolet rays and in particular to a hollow-cathode gas-discharge tube.

It is suitable for use with atomic-absorption and atomic-fluorescent spectrophotometers in spectroscopic research.

PRIOR ART

Known in the art are hollow-cathode gas-discharge tubes comprising an envelope filled with an inert gas and provided with a window designed to pass line spectrum emission of chemical elements, said envelope containing an anode and a cathode which are isolated from one another.

In the known tubes the cathode is provided with a cylindrical cavity open on the side of the anode.

The line spectrum emission of a specific chemical element in such tubes is provided by initiating a glow discharge within the hollow cathode fabricated from the metal whose emission spectrum is to be obtained, while the intensity of the resonance emission is enhanced by increasing the discharge current.

As the discharge current is increased, a cloud of unexcited atomic vapours is produced at the output of the cylindrical cavity of the cathode, said cloud being formed due to diffusion of the atoms of the chemical elements beyond the cathode cavity.

The existence of such a cloud in the prior art tubes has generally led to self-absorption of the resonance emission, a disadvantage decreasing its intensity and distorting the profile of a resonance emission line.

To reduce this and other undesired effects, one of the known gas-discharge tubes incorporates a hollow cathode representing a massive cylinder with cooling ribs on the side surface thereof, a feature enhancing the emission intensity, decreasing the width of the spectral lines, and providing undistorted regular lines in the region of maximum values. Furthermore, the aforesaid tube includes an additional electrode representing a tubular screen electrically coupled to the anode and arranged within the enevelope between the anode and the cathode in the immediate vicinity of the output of the cylindrical cavity of the cathode (cf. USSR Inventor's Certificate No. 395,927; C1. HOII61/09).

In such a tube an ineffective heat transfer within an evacuated medium prevents a noticeable decrease of the cathode temperature, whereas the presence of an additional discharge between the cathode and the tubular screen essentially precludes the excitation of a cloud of atomic vapours in front of the cathode cavity due to low concentration of electrons with energies close to the resonance level excitation energy.

In the aforementioned tube the intensity of the resonance lines may not, therefore, be enhanced without form distortion.

BRIEF DESCRIPTION OF THE INVENTION

It is an object of the present invention to provide a hollow-cathode gas-discharge tube wherein intensity of resonance lines may be enhanced without form distortion.

The foregoing object is accomplished by that in a hollow-cathode gas-discharge tube comprising an envelope filled with an inert gas and having a window designed to pass line spectrum emission of chemical elements, said envelope containing an anode and an isolated cathode with a cylindrical cavity having a diameter d, which is open on the side of the anode, and an end surface disposed on said side, according to the invention, the anode represents a hollow body of revolution open on both ends, said body being arranged within the envelope coaxially with the cylindrical cavity of the tube cathode and composed of a hollow cylindrical portion mating a hollow variable-section portion, the hollow cylindrical portion of the anode being arranged in the vicinity of the end surface of the cathode and representing a hollow cylindrical structure with a cavity diameter D and a bottom having a central opening and disposed level with or below the end surface of the cathode, the hollow variable-section portion containing a cavity whose diameter evenly increases in the direction of emission from the cavity diameter D of the cylindrical portion of the anode, a height 1 of the cylindrical portion of the anode, its cavity diameter D, and the diameter d of the cylindrical cavity of the cathode being related to one another as follows:

$$3d \leqq 1 \leqq 6d$$

$$2 \leqq D/d \leqq 4$$

the hereinproposed hollow-cathode gas-discharge tube features enhanced spatial density of an electron flow at the output of the cylindrical cavity of the cathode with the chosen relations between the anode and cathode parameters.

Due to this, a greater numer of emissive transitions is utilized and the excitation of neutral atoms disseminating beyond the cathode is enhanced.

Thus, the absorption of the resonance emission is compensated for and the intensity of the resonance lines is increased without form distortion.

BRIEF DESCRIPTION OF THE ACCOMPANYING DRAWING

The invention will be described further with reference to a specific embodiment thereof, taken in conjunction with the accompanying drawing which is a longitudinal section of a hollow-cathode gas-discharge tube in the direction of emission according to the invention.

DETAILED DESCRIPTION OF THE INVENTION

Referring to the drawing the hollow-cathode gas-discharge tube forming the subject of the present invention comprises a cylindrical glass envelope 1 filled with an inert gas and provided with a flat window 2 transparent in the spectral range of 0.21 to 2.0 μm, said window being used to pass line spectrum emission of chemical elements.

A cathode 3 of the tube has a cylindrical cavity 4 with a diameter d and an end surface 5.

The cathode 3 is fabricated from a material whose spectrum is to be obtained in tube emission. The same material may also be deposited on the surface of the cylindrical cavity 4 of the cathode 3.

On the outside the cathode 3 is surrounded by a ceramic insulator 6.

An anode 7 of the tube is composed of a suitable metal such, for example, as nickel. It represents a hollow body of revolution open on both ends, which is arranged within the envelope 1 coaxially with the cylindrical cavity 4 of the cathode 3 on the side of the end surface 5 thereof.

The anode 7 contains a hollow cylindrical portion 8 arranged in the vicinity of the end surface 5 of the cathode 3 and representing a hollow cylindrical structure with a diameter D and a bottom 9 having a central opening 10 and disposed level with or below the end surface 5 of the cathode 3.

Such a position of the bottom 9 of the portion 8 of the anode 7 assures coaxial arrangement of the anode 7 with respect to the cylindrical cavity 4 of the cathode 3, a condition necessary for forming a symmetrical electron lens.

The hollow cylindrical portion 8 of the anode 7 passes into a hollow variable-section 11 thereof to eliminate the iris effect.

The hollow portion 11 contains a cavity whose diameter evenly increases in the direction of emission from the cavity diameter D of the cylindrical portion 8.

The anode 7, cathode 3, insulator 6, centering mica discs 12, ceramic tubes 13, and a contact plate 14 are built around terminals 15 of a flat glass prong 16 by the known method of fabricating electrovacuum devices.

The envelope 1 is filled with an inert gas such, for example, as neon at a pressure of 4 to 8 mm Hg.

The height 1 of the cylindrical portion 8 of the anode 7, its cavity diameter D, and the diameter d of the cylindrical cavity 4 of the cathode 3 are related to one another as follows:

$$3d \leqq 1 \leqq 6d$$

$$2 \leqq D/d \leqq 4$$

The above relations have been chosen experimentally. It has been proved that a further decrease of the diameter ratio D/d due to the decreasing diameter D results in a corresponding reduction of the emission intensity associated with the iris effect of the anode 7, while an increase of the above ratio beyond the specified limit delocalizes an electron flow in the region of maximum concentration of atomic vapours, a feature reducing the intensity of the resonance emission and impairing the electrical characteristics of the tube.

It has been also proved that a decrease of the height 1 beyond the specified limit causes delocalization of an electron flow associated with the increasing focal length of the electron lens formed by the cylindrical portion 8 of the anode 7 whereby the intensity of the resonance emission will be reduced.

If the height 1 increases beyond the specified limit, the emission intensity will be reduced due to the iris effect.

The operating principle of the tube forming the subject of the present invention consists in the following. A glow discharge is initiated between the cathode 3 and the anode 7. The bombardment of the wall of the cavity 4 of the cathode 3 with positive ions results in the formation of atomic vapours of the material of the cathode 3 in the discharge channel. As the atomic vapours are excited, emission is caused primarily due to an electron shock.

The anode 7 and the cathode 3 form a converging electron lens which focuses the electron flow, thereby enhancing its spatial density and increasing the number of emissive transitions due to localization of the electron flow in the region of maximum concentration of the atomic vapours.

The insulator 6 precludes the occurrence of a spurious glow discharge from the external surface of the cathode 3 and increases the intensity of the resonance emission from the cylindrical cavity 4 of the cathode 3.

Moreover, the emission of the cathode 3 absorbed by neutral atoms at the output of its cylindrical cavity 4 and evenly reradiated by said atoms in all directions is returned to the output of the cavity 4 of the cathode 3 due to reflection from the internal surface of the anode 7 and excites the neutral atoms whereby the emission intensity of the resonance lines will be enhanced.

The formation of a symmetrical electron lens in the hereinproposed gas-discharge tube comprising the hollow cathode 3 enhances spatial density of the electron flow at the output of the cylindrical cavity 4 of the cathode 3 with the chosen parametric relations between the anode 7 and the cathode 3.

This increases the number of emissive transitions and causes additional excitation of neutral atoms migrating beyond the cathode 3, an advantage preventing absorption of the central portion of the profile of the resonance emission line.

The absorption of the resonance emission causing self-reversal of the lines is compensated for. Furthermore, the intensity of the resonance lines is enhanced.

In the hereinproposed tube the intensity of the resonance emission is additionally enhanced by increasing a discharge current some 30% as compared to the prior art, without any form distortion of the lines.

The utilization of the hereinproposed hollow-cathode gas-discharge in atomic-absorption devices enhances sensitivity thereof and increases detection limits of chemical elements in analysis due to an undistorted profile of a resonance emission line of the tube and reduced amplification factor.

What is claimed is:

1. A hollow-cathode gas-discharge tube comprising:

an envelope filled with an inert gas and provided with a window designed to pass line spectrum emission of chemical elements;

an anode of said tube contained within said envelope;

a cathode of said tube contained within said envelope and isolated from said anode, said cathode being provided with a cylindrical cavity having a diameter d, which is open on the side of said anode, and an end surface disposed on said side;

said anode of said tube representing a hollow body of revolution open on both ends and arranged within said envelope coaxially with said cylindrical cavity of said cathode, said body being composed of a hollow cylindrical portion mating a hollow variable-section portion;

said hollow cylindrical portion of said anode arranged in the vicinity of said end surface of said cathode and representing a hollow cylindrical structure with a cavity diameter D and a bottom provided with a central opening and disposed level with or below said end surface of said cathode;

said hollow variable-section portion of said anode containing a cavity whose diameter evenly increases in the direction of emission from said diameter D of said preceding cylindrical portion of said anode, a height 1 of said cylindrical portion of said anode, said diameter D of its cavity, and said diameter d of said cylindrical cavity of said cathode being related to one another as follows:

$$3d \leqq 1 \leqq 6d$$

$$2 \leqq D/d \leqq 4.$$

* * * * *